United States Patent [19]

Cagan et al.

[11] 4,212,285

[45] Jul. 15, 1980

[54] DART GUN AND DART THEREFOR

[75] Inventors: Bernard J. Cagan, Los Angeles; Kenneth L. McQuary, Hermosa Beach, both of Calif.

[73] Assignee: Placo Products Company, Torrance, Calif.

[21] Appl. No.: 874,032

[22] Filed: Jan. 31, 1978

[51] Int. Cl.[2] ..... F41B 11/00

[52] U.S. Cl. ..... 124/67; 273/344

[58] Field of Search ..... 124/65, 66, 67, 27, 124/83, 41 R, 41 C, 62, 22; 46/1 E; 273/106.5 R, 106.5 A, 106 F, 106.5 C; 102/38 NC, 92.1

[56] References Cited

U.S. PATENT DOCUMENTS

| | | | |
|---|---|---|---|
| 786,426 | 4/1905 | Daniels | 124/66 |
| 1,704,810 | 3/1929 | Sperry | 124/22 |
| 2,649,849 | 8/1953 | Parris | 124/66 |
| 2,888,004 | 5/1959 | Steiner | 124/27 |
| 3,104,588 | 9/1963 | Glorvig | 102/38 NC X |
| 3,388,696 | 6/1968 | Hoverath et al. | 124/62 |
| 3,472,218 | 10/1969 | La Mers | 124/67 |
| 3,801,102 | 4/1974 | Lohr et al. | 273/106.5 A |
| 3,859,977 | 1/1975 | Lange | 124/66 |

FOREIGN PATENT DOCUMENTS

| | | | |
|---|---|---|---|
| 145220 | 4/1936 | Austria | 124/27 |
| 195806 | 2/1958 | Austria | 124/27 |
| 1043352 | 6/1953 | France | 273/106.5 A |
| 1046235 | 7/1953 | France | 273/106.5 A |
| 418 | of 1718 | United Kingdom | 102/92.1 |
| 963384 | 7/1964 | United Kingdom | 273/106.5 R |

*Primary Examiner*—Richard T. Stouffer

*Attorney, Agent, or Firm*—Harris, Kern, Wallen & Tinsley

[57] ABSTRACT

A one-piece dart comprising a shaft having an integral suction cup at its forward end and an integral, air actuable, propelling element at its rearward end, the dart being molded from a soft, flexible plastic material. A spring activated air operated dart gun including a dart barrel having a non-circular cross section uniform throughout the length of the barrel, the propelling element on the dart being complementary to the dart barrel so that the propelling element makes a substantially air tight seal with the dart barrel. A dart barrel and a dart propelling element which are substantially square. An air operated dart gun having a barrier for positively preventing physical contact between an air displacing piston and the dart, and for making physical contact between the piston and a foreign object in the dart barrel virtually impossible. A piston provided with a central conical element facing the dart barrel. A dart gun having an air cylinder and a dart barrel which are separate pieces capable of being joined directly together, or in spaced relation by a connecting air passage.

4 Claims, 9 Drawing Figures

DART GUN AND DART THEREFOR

BACKGROUND OF INVENTION

The present invention relates in general to an air operated dart gun, and to a dart therefor.

As further background, relevant prior art includes the following, all U.S. Pat. Nos. except the last: 2,031,785, North et al 2,630,108, White, 3,472,218, La Mers, 3,859,977, Lange, 3,968,784, Miller, 1,017,630, (France).

North et al, White, Lange and the French patent disclose barrier means tending to reduce the possibility of direct physical contact between pistons and foreign objects. Of these, however, only Lange relates to a dart gun and, in Lange, the dart and the barrier means are so designed that the piston makes direct physical contact with the dart. La Mers and Miller disclose a barrel or muzzle which is at least partially noncircular in cross section, but not a dart barrel having a noncircular cross section which is uniform throughout the length of the barrel. With further respect to Miller, this patent does not disclose an air operated dart gun, but one which is actuated by physical force applied directly to the dart. Those of the above references which relate to dart guns disclose multi-piece darts.

OBJECTS AND SUMMARY OF INVENTION

A general object of the invention is to provide a dart gun, and a dart therefor, which constitute improvements on the guns disclosed in the aforementioned references, and particularly the dart guns and darts disclosed therein.

More particularly, an important object of the invention is to provide, and the invention may be summarized as including, an air operated dart gun comprising a dart barrel having a noncircular cross section which is uniform throughout the length of the barrel, and a dart insertable into the barrel and having at its rearward end a noncircular propelling element complementary to the barrel and capable of substantially air tight engagement therewith. A related important object is to provide an air operated dart gun and a dart therefor, wherein the barrel is substantially square in cross section throughout its length, and wherein the complementary propelling element on the dart is also substantially square.

An important feature of the invention is that the foregoing uniform noncircular, and preferably substantially square, cross section of the dart barrel throughout its length, minimizes the possibility of compressed air propulsion of a foreign object inserted into the dart barrel. In other words, a foreign object susceptible of compressed air propulsion in such a dart barrel would be an extreme rarity.

The invention may be further summarized as including, and yet another important object of the invention is to provide, an air operated dart gun which includes: an air cylinder; a dart barrel connected to the cylinder; a piston in the cylinder; means for propelling the piston in the cylinder toward the barrel to displace air under pressure from the cylinder into the barrel; a dart insertable into the barrel; barrier means for positively preventing physical contact between the piston and the dart and for minimizing the possibility of physical contact between the piston and a foreign object in the barrel; and air passage means connecting the cylinder to the dart barrel and bypassing the barrier means.

Another object is to provide the piston of the foregoing dart gun with a central conical element facing the dart barrel, such conical element tending to wedge in the barrel any foreign object which is slender or flexible enough to be inserted past the barrier means into possible physical contact with the piston.

Additional objects are to provide a dart gun wherein the cylinder and the dart barrel are separate pieces which are directly interconnected, and a dart gun wherein the cylinder and the dart barrel are spaced apart with an elongated, nonlinear air passage interconnecting same. With the latter construction, physical contact between a foreign object and the piston is virtually impossible.

Yet another object is to provide a dart gun wherein the air passage means bypassing the barrier means is laterally offset from the cylinder axis.

Considering another aspect of the invention, a primary object is to provide a one-piece dart molded from a soft, flexible plastic material, and comprising a shaft having a forward end provided with an integral suction cup and a rearward end provided with an integral propelling element adapted to make a substantially air tight seal with a complementary dart barrel. A related object is to provide a one-piece molded dart having an A Shore hardness in about the range of 50 to 75, another object being to utilize polyvinyl chloride, although other materials having similar characteristics can be used, such as Kraton, EVA, natural rubber compounds, etc.

Yet another important object in connection with the dart of the invention is to provide a construction wherein the propelling element at the rear of the dart comprises an external flange projecting laterally from the shaft and engageable in substantially air tight relation with a dart gun barrel, and wherein the external flange is noncircular. A further and preferred object in this connection is to provide a one-piece molded dart of flexible plastic material wherein the propelling element formed by the external flange is substantially square.

As will be apparent, the foregoing barrier means, the soft, flexible, one-piece dart, and the noncircular dart barrel and the complementary propelling element on the dart, all cooperate to provide a dart gun which minimizes the possibility of injury either to the user, or to persons in the vicinity. The dart gun configuration and the dart configuration makes it virtually impossible to propel a foreign object from the dart gun, while the soft plastic construction of the dart make injury by the dart itself very unlikely.

While the dart gun of the invention is referred to herein as air operated, any gas can be used, and the term "air" is intended to cover other gases.

The foregoing objects, advantages, features and results of the invention, together with various other objects, advantages, features and results thereof which will be evident to those skilled in the dart gun art in the light of this disclosure, may be achieved with the exemplary embodiments of the invention illustrated in the accompanying drawings and described in detail hereinafter.

DESCRIPTION OF EXEMPLARY EMBODIMENTS OF INVENTION

Referring initially to FIGS. 1 to 7 of the drawings, the dart gun of the invention is designated generally by the numeral 10 and is intended for use with a dart 12 of the invention, which dart will be described in more detail hereinafter.

Figure 2:
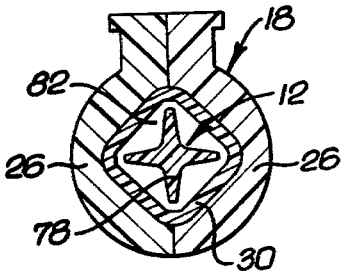
FIG. 2 is an enlarged, transverse sectional view showing the dart barrel of the gun and the dart in cross section.

The dart gun 10 is shown as having the general configuration of an automatic pistol and includes a housing having, among other things, the usual grip 14, butt section 16, barrel section 18, trigger guard 20, front sight 22, and rear sight 24. As shown in FIG. 2, for example, the housing of the dart gun 10 may be molded from any suitable plastic in two halves 26 suitably bonded together.

Within the barrel section 18 of the dart gun 10 are an air cylinder 28 and a dart chamber or barrel 30 in axial alignment. While the air cylinder 28 and the dart barrel 30 may be molded in one piece, they are preferably separate parts which, in the construction illustrated, are telescopically connected, as in the case of the housing halves 26, the air cylinder 28 and the dart barrel 30 are preferably molded from a suitable plastic material, the same being true of virtually all of the other parts of the dart gun 10.

Within the air cylinder 28 is a cup-shaped plunger or piston 32 which faces the dart barrel 30. The piston 32 is mounted on a tubular carrier 34 and is connected to an end 36 thereof by a pin 38 terminating in a conical head or head element 40 within the piston and facing the dart barrel 30. At its rearward end, the piston carrier 34 is provided with two oppositely laterally extending tabs 42 which project laterally outwardly through guide slots 44 in the housing halves 26.

The dart gun 10 includes a trigger member 46 pivotally mounted on the housing halves 26 by a transverse pivot 48, and provided with a trigger 50 extending into the trigger guard 20. The trigger member 46 also includes an arm 52 disposed in diametrally opposed guide slots 54 in the piston carrier 34. A metallic compression coil spring 56 is disposed in the piston carrier 34 and is seated at one end against the end 36 of the piston carrier, the other end of the spring being seated against the trigger member arm 52 and being retained by a tab 58 on the trigger member arm.

The trigger member 46 is also provided with a catch 60 insertable into a slot 62 in the piston carrier 34. The catch 60 is provided with a shoulder 64 which is engageable with the rearward end of the slot 62 to releasably lock the piston carrier 34 in the position shown in FIG. 1, against the action of the spring 56.

Figure 1:
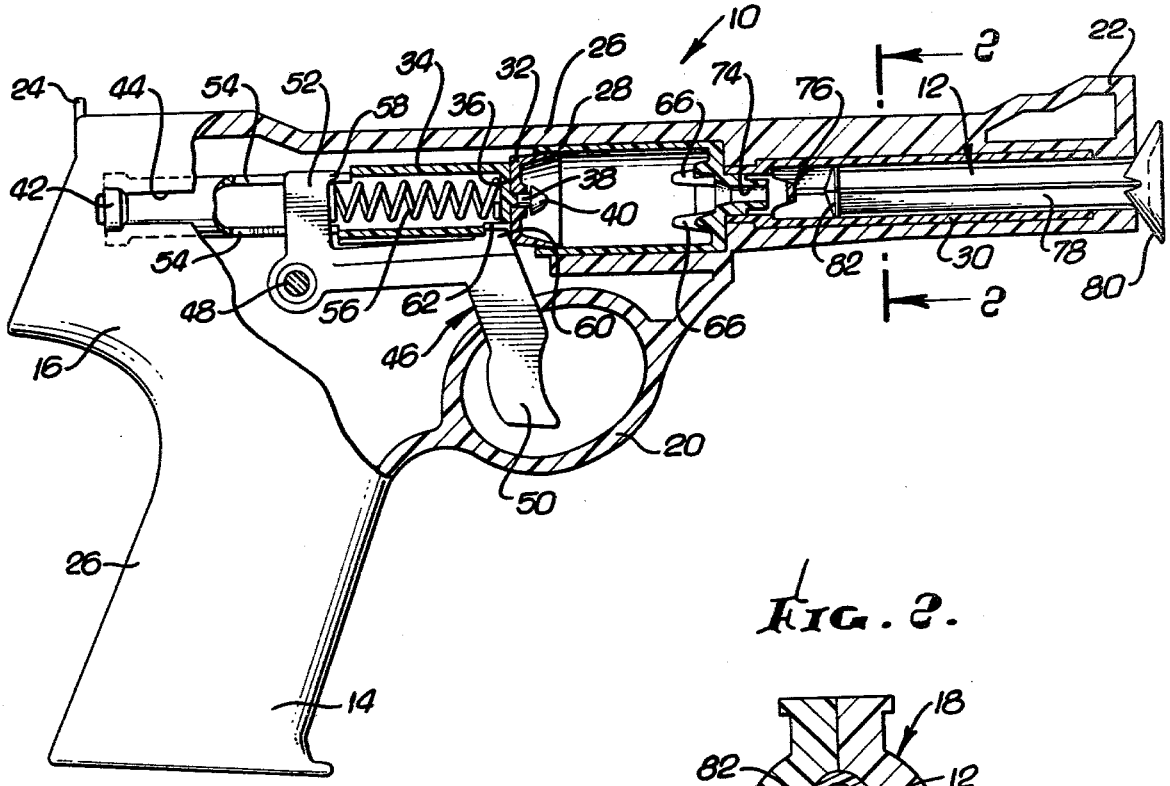
FIG. 1 is a side elevational view, partially in longitudinal section, illustrating an air operated dart gun and a dart of the invention.

Considering the opearation of the dart gun 10 as thus far described, it will be apparent that, to cock the dart gun 10, the user grips the tabs 42 with his thumb and forefinger and retracts the piston carrier 34 rearwardly into the position shown in FIG. 1, thereby compressing the spring 56. The shoulder 64 on the catch 60 engages the rearward end of the slot 62 in the piston carrier 34 to releasably latch the piston carrier 34 in its rearward, cocked position.

Figures 4, 5, 6:
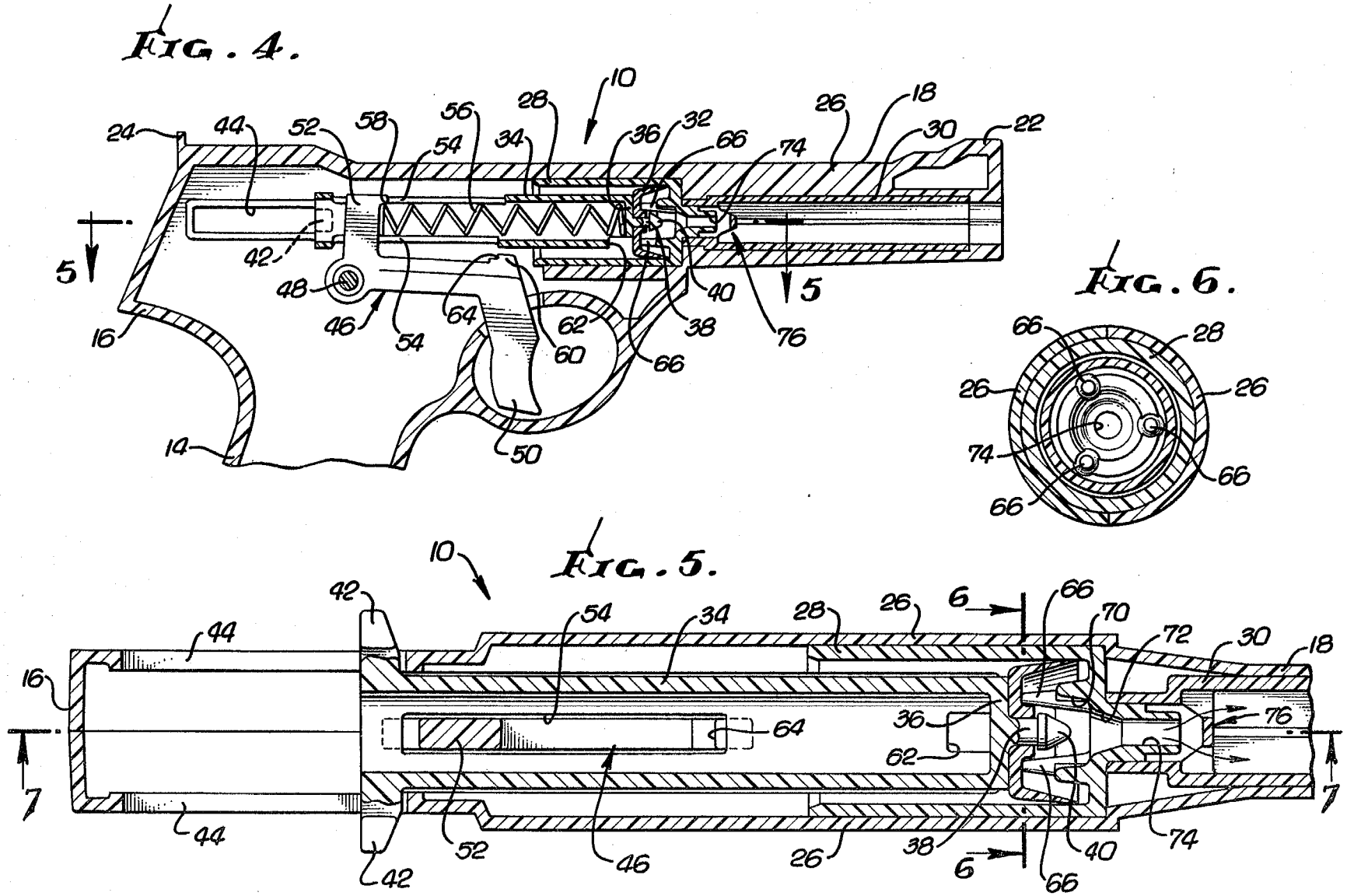
FIG. 4 is a view similar to FIG. 1, but showing various parts in different operating positions.
FIG. 5 is an enlarged, fragmentary sectional view taken as indicated by the arrowed line 5—5 of FIG. 4.
FIG. 6 is a transverse sectional view taken as indicated by the arrowed line 6—6 of FIG. 5.
Figure 7:
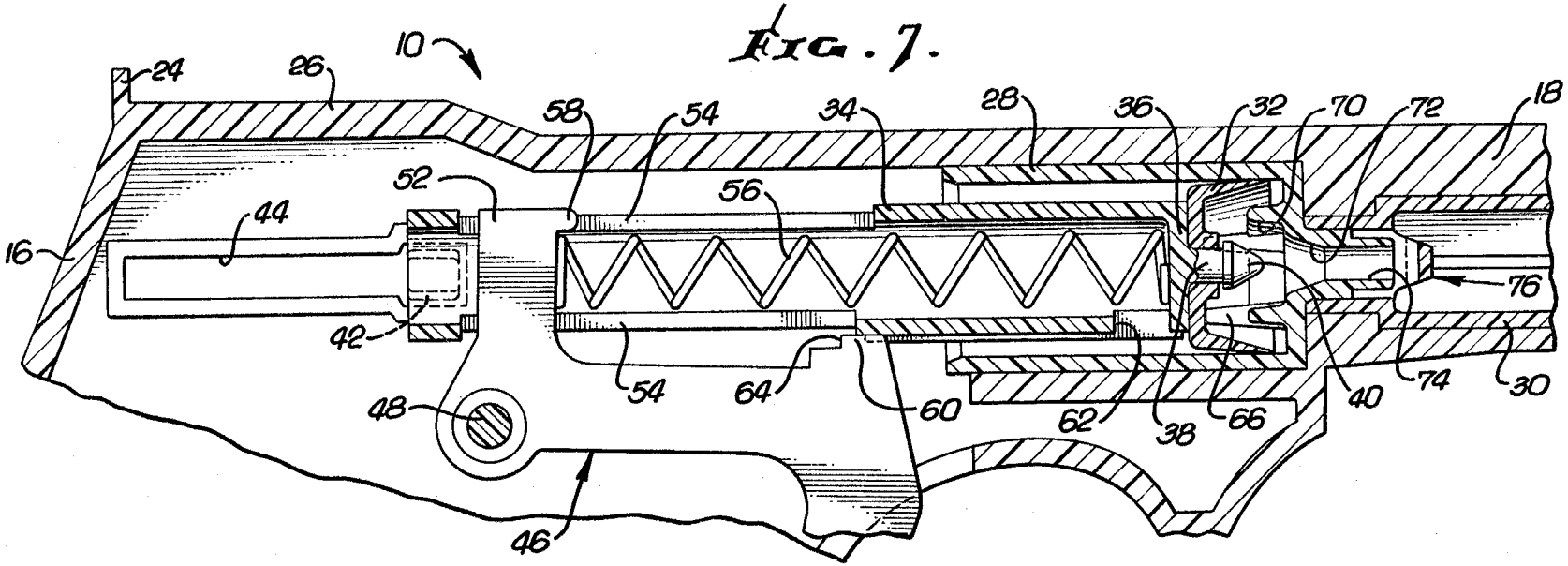
FIG. 7 is a fragmentary sectional view taken as indicated by the arrowed line 7—7 of FIG. 5.

As will be apparent, by pulling rearwardly on the trigger 50, the piston carrier 34 is released so that the spring displaces it and the piston 32 forwardly at high speed to deliver compressed air to the rearward end of the dart barrel 30 through an air passage or air passage means to be described. Forward movement of the piston 32 and the piston carrier 34 is terminated by engagement of the piston with circumferentially spaced, rearwardly extending stop pins 66 molded integrally with the forward end of the air cylinder 28. FIGS. 4, 5 and 7 show the piston 32 at the forward end of its travel, and in engagement with the stop pins 66.

The compressed air discharged from the air cylinder 28 by the piston 32 when the piston carrier 34 is released, in the manner hereinbefore described, enters the rearward end of the dart barrel 30 through an air passage means which includes convergent portions 70 and 72 terminating in a central axial passage 74 which is of relatively small diameter for a reason to be discussed hereinafter. These components of the air passage means are formed integrally with the forward end of the air cylinder 28, as will be clear, for example, from FIG. 5 of the drawings.

Formed integrally with the rearward end of the dart barrel 30 is a barrier means 76 shown as comprising a transverse barrier extending across the interior of the dart barrel 30 just downstream from, i.e., forwardly of, the central axial air passage 74.

The barrier means 76 performs a number of functions, one being to positively prevent direct physical contact between the piston 32 and the dart 12, so that the dart is propelled solely by air pressure behind it, as will be discussed hereinafter. Perhaps more important, the barrier means 76 makes it virtually impossible for any foreign object in the dart barrel 30 to come into direct physical contact with the piston 32. Thus, there is virtually no possibility of direct mechanical propulsion of a foreign object by the piston 32, which is an important safety feature of the invention. In the event that a long, slender foreign object is inserted into the dart barrel 30, past the barrier means 76, and through the central axial passage 74, the rearward end of such an object will be engaged by the central conical element 40 on the piston 32 and deflected laterally, thereby wedging such an object within the dart gun 10 so that it cannot be mechanically propelled by physical contact with the piston 32. It will be understood, of course, that the possibility of such a long, slender object being inserted past the barrier means 56 and through the central axial passage is extremely remote, due to the relatively small diameter of the passage 74, and the obstruction provided by the barrier means 76 forwardly thereof. Thus, direct physical contact between the piston 32 and a foreign object is very unlikely, and mechanical propulsion of a foreign object is next to impossible, which are important safety features. For reasons which will be discussed hereinafter, air propulsion of a foreign object is also next to impossible, another important safety feature.

Turning now to a consideration of the dart barrel 30, it has a noncircular cross section which is uniform throughout its length. Preferably, as best shown in FIG. 2, the uniform cross section of the dart barrel 30 is substantially square, although other noncircular, uniform cross sections might be used within the scope of the invention.

The foregoing cross-sectional configuration of the dart barrel 30 makes air propulsion of a foreign object placed in the dart barrel virtually impossible since only a foreign object conforming closely in cross section to that of the dart barrel could be ejected by compressed air behind it, an extremely unlikely eventuality. This is another important safety feature of the dart gun 10 of the invention.

Figure 3:
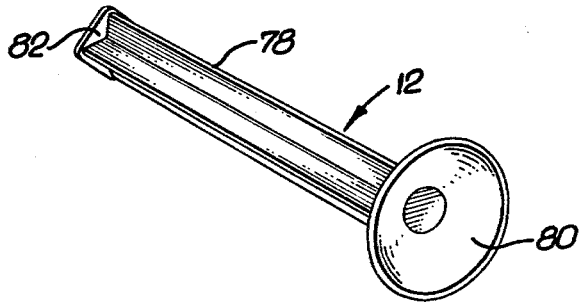
FIG. 3 is a perspective view of the one-piece dart of the invention.

The dart 12 is complementary in cross section to the dart barrel 30 and, as shown in FIGS. 1, 2 and 3, includes a shaft 78 having a forward end provided with a suction cup 80 and having a rearward end provided with a propelling element 82 in the form of an external flange conforming closely in cross-sectional configuration to that of the dart barrel 30, as will be clear from FIG. 2. For example, the lateral dimensions of the element 82 are preferably within ±0.002" of those of the barrel 30 for a gas tight fit, the element 82 being sufficiently flexible that it can be slightly oversized. Thus, the propelling element 82 has a substantially air tight fit in the dart barrel 30 so that compressed air discharged from the air cylinder 28 propells the dart 12 from the dart barrel 30 with a substantial velocity, so that the suction cup 80 will adhere to the desired target.

Another important feature of the invention is that the dart 12 is a one-piece dart molded from a soft, flexible plastic material so that even if it strikes the user, or a person in the vicinity, injury is extremely unlikely, still another important safety aspect of the invention.

In the particular construction illustrated, the molded shaft 78 is of cruciform cross section, the ribs of which align with the corners of the substantially square dart barrel 30. The suction cup 80 and the propelling element 82 are molded integrally with the shaft 78. The corners of the propelling element 82 are aligned with the ribs of the shaft 78, as shown in FIG. 2, and fit into the corners of the substantially square dart barrel 30.

To obtain the desired softness of the dart 12 for safety reasons, the plastic material of which the dart is made has an A Shore hardness in about the range of 50 to 70, a suitable material being polyvinyl chloride, although other materials having similar characteristics might be used. Such a soft dart 12, as hereinbefore indicated, is virtually injury proof. Also, the dart 12 weighs only about two grams, which minimizes its kinetic energy, and thus the risk of injury.

Figure 8:
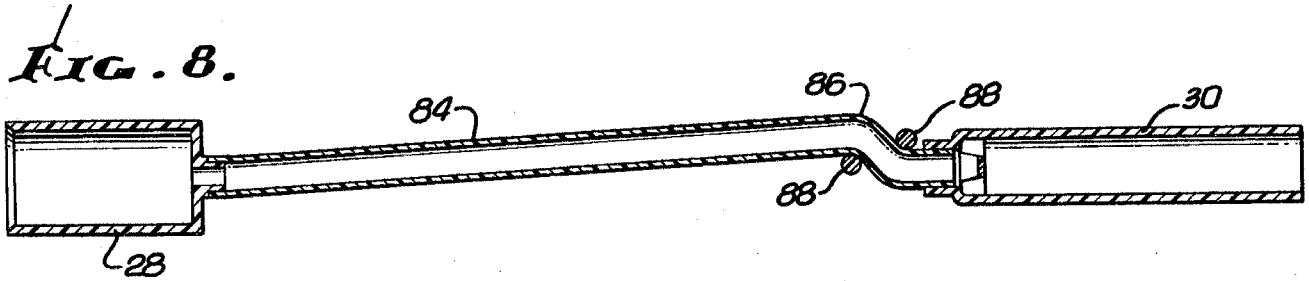
FIG. 8 is a semidiagrammatic, longitudinal sectional view of an alternative embodiment of the dart gun of the invention.

Turning to FIG. 8 of the drawings, the air cylinder 28 and the dart barrel 30, instead of being directly interconnected in telescopic relation, are shown as interconnected in spaced relation by an air passage 84, which may be a length of plastic tubing. This construction may, for example, be used in a dart rifle analogy to the dart gun 10. Preferably, the air passage 84 is provided with an offset 86, as by means of pins 88 on opposite sides thereof in staggered relation. As will be apparent, with this construction, direct physical contact between a piston in the air cylinder 28 and a foreign object in the dart barrel 30 is almost certainly an impossibility.

Figure 9:
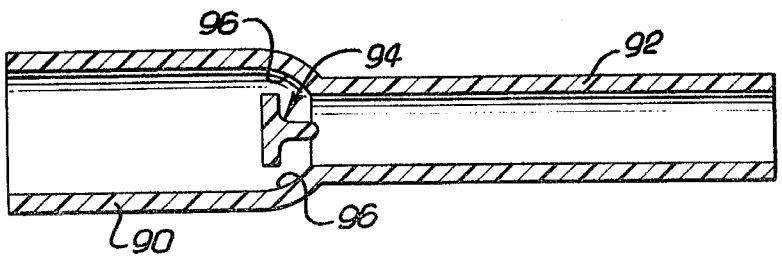
FIG. 9 is a semidiagrammatic, longitudinal sectional view illustrating still another embodiment of the invention.

FIG. 9 shows an alternative construction of an air cylinder 90 and a dart barrel 92 having a barrier means 94 adjacent their junction, air flow from the cylinder 90 to the barrel 92 being by way of laterally offset air passages 96 bypassing the barrier means 94 and spaced laterally from the axis of the cylinder 90 and the barrel 92. This construction also makes virtually impossible direct physical contact between a foreign object in the barrel 92 and a piston in the air cylinder 90, which is, of course, an important safety feature. The embodiment of FIG. 9 can be molded in one piece, or split longitudinally.

Although exemplary embodiments of the invention have been disclosed for illustrative purposes, it will be understood that various changes, modifications and substitutions may be incorporated in such embodiments without departing from the invention as hereinafter claimed.

We claim as our invention:

1. In an air operated dart gun, the combination of:
(a) an air cylinder;
(b) a dart barrel connected to said cylinder;
(c) a piston in said cylinder;
(d) means for propelling said piston in said cylinder toward said dart barrel to displace air under pressure from said dart barrel;
(e) a one-piece dart comprising a shaft having a forward end provided with an integral, circular suction cup larger than said shaft and having a rearward end insertable into said dart barrel and provided with an integral propelling element larger than said shaft and complementary to said dart barrel;
(f) barrier means for positively preventing physical contact between said piston and said propelling element of said dart, and for making physical contact between said piston and a foreign object in said dart barrel virtually impossible; and
(g) serpentine shaped air passage means connecting said cylinder to said dart barrel and having a laterally offset portion bypassing said barrier means and making insertion of a foreign object around said barrier means into contact with said piston virtually impossible.

2. A dart gun as defined in claim 1 wherein said piston is provided with a central conical element facing said dart barrel.

3. A dart gun according to claim 1 wherein said cylinder and said dart barrel are spaced apart and wherein an elongated air passage interconnects same.

4. A dart gun according to claim 1 wherein said dart barrel has a noncircular cross section which is uniform throughout its length, and wherein said propelling element is also noncircular and complementary to said noncircular dart barrel.

* * * * *